United States Patent [19]

Whitaker

[11] 4,159,471

[45] Jun. 26, 1979

[54] COMMUNICATION SYSTEM USING BINARY COMPATIBLE CHARACTERS

[76] Inventor: Ranald O. Whitaker, 4719 Squire Dr., Indianapolis, Ind. 46241

[21] Appl. No.: 593,434

[22] Filed: Jul. 7, 1975

Related U.S. Application Data

[63] Continuation-in-part of Ser. No. 403,873, Oct. 5, 1973, abandoned, which is a continuation-in-part of Ser. No. 178,173, Sep. 7, 1971, abandoned, which is a continuation-in-part of Ser. No. 827,478, May 19, 1969, abandoned.

[51] Int. Cl.[2] ..... G09F 9/32

[52] U.S. Cl. ..... 340/711; 283/1 R; 340/146.3 Z; 400/100; 400/109; 400/125; 400/140

[58] Field of Search ..... 197/25, 4; 340/324 R, 340/324 M, 378 R, 336, 146.3 A, 146.3 Z; 178/15, 30, 21, 113; 283/1, 17

[56] References Cited

U.S. PATENT DOCUMENTS

| | | | |
|---|---|---|---|
| 39,296 | 7/1863 | Livermore | 197/25 |
| 1,267,640 | 5/1918 | Eagelston | 283/1 R |
| 3,163,716 | 12/1964 | Matsuzaki | 325/47 |
| 3,242,855 | 3/1966 | Noll et al. | 340/336 |
| 3,493,928 | 3/1970 | Juliusberger | 340/365 E |
| 3,559,170 | 1/1971 | Barnes | 340/146.3 Z |

*Primary Examiner*—Marshall M. Curtis

[57] ABSTRACT

A "Binary Compatible Character" consisting of nine straight line segments and a dot is provided. Subsets of the ten elements of the character form digits of the base-16 numbering system, letters of several alphabets, punctuation marks, mathematical operators, and phonemes. The invention covers simplified apparatus for reading the characters and forming the characters. A ten key keyboard incorporating parity check, a ten hammer composite printing head, and a ten photodetector reading head are prime elements of the invention. The combination of printer, printed matter, and reader constitute a data storage system for which the data may be most easily edited by a human using only an eraser and pencil.

9 Claims, 11 Drawing Figures

COMMUNICATION SYSTEM USING BINARY COMPATIBLE CHARACTERS

RELATED APPLICATION

This application is a continuation-in-part application of application Ser. No. 403,873 filed 10-5-73, which application is a continuation-in-part application of application Ser. No. 178,173, filed Sept. 7, 1971, which application is a continuation-in-part application of application Ser. No. 827,478, filed May 19, 1969 all now abandoned.

SUMMARY OF THE INVENTION

Binary data systems of which a prime example is a modern digital computer store and transfer information via "binary coded words". In the preferred embodiment of the present invention each word is ten bits in length. Each bit may be either high or low. That which is represented by the coded word is a function of the combination of the highs and lows of the word.

In the preferred embodiment of the present invention a ten element master printed "Binary Compatible Character" is provided. Individual characters are formed by selecting subsets of the elements of this master character. A total of 1023 such "binary compatible characters" are possible. A one-to-one correspondence between elements of the master character and bits of the computer word is maintained. This permits direct communication between printed characters and binary registers of any binary data system. A photoreader senses elements present in the binary compatible character being read and sets the binary devices of a register in accordance. In outputting information from a register, a printer prints elements of the binary compatible character in accordance with the contents of the register. Storage of information is accomplished by storing the printout and feeding it at a later date to the photoreader.

A modified "typewriter" using a ten key combinational keyboard to print the binary compatible character directly is provided.

BACKGROUND OF THE INVENTION

If data systems were to use the base-10 numbering systems, Arabic digits, and the Roman alphabet—there would be no need for the present invention. Unfortunately, they don't. All information in such systems is stored and manipulated in "words" consisting of a fixed number of "bits" (8, 10, 12, and 16 being common), each of which bits may be in a high or a low condition, and the particular combination of highs and lows in any given word being a code for a certain piece of information.

On the other hand, if we were to drop our base-10 numbering system and adopt a binary derived system (one whose radix is 4, 8, 16, 32, or other integral power of 2), drop our Arabic digits and adopt a set of "binary compatible digits", and drop our Roman alphabet in favor of a binary derived alphabet (or binary derived set of phonemes) the problem of communicating with binary data systems would disappear.

However, it does appear that the binary numbering system used by binary data systems renders the decimal system obsolete. It appears that the advantages associated with a change to the base-16 numbering system are sufficient to justify the change.

It also appears that to ease the problem of communicating with binary data systems we should adopt a "binary compatible character" for representing digits of the base-16 numbering system, letters of the alphabet, other communication symbols, and perhaps the phonemes of the several languages.

Our presently used typewriter keyboards employ the "one peck at a time" technique—necessitated by the mechanical features of the first typewriter to be built. Electronics now makes it far more practical to operate keys in combinations. Such a combinational keyboard is particularly well suited for generating the codes used in a binary data system since these codes may be generated directly without requirement for a code converter.

Binary data systems often need to store information. Magnetic tape is perhaps the most common medium for such storage. This need for a storage system can be eliminated if the output of the data system (usually printed copy) can be easily read by the input device. Such a system has the further advantage that a human can read and edit the information being stored.

A binary data system is a system in which information is carried by a sequence of signals. Each signal may be in a high or a low state. Information carried by the sequence of signals is that ascribed by previous arrangement to each particular combination of highs and lows. The sequence may be in time (serial) or in space (parallel). For storage of information, binary data systems use registers consisting of a sequence of binary devices.

A binary device is exemplified by the latching relay. It is either closed or it is open. A manually operated switch is a binary device. It is either on or it is off. A magnetic core is a binary device. It is either magnetized clockwise or magnetized counterclockwise. Any one of the many electronic flip-flops available today is a binary device. Its output is either high or it is low. It follows that any element which when placed in one of two states remains in that state until changed by some outside influence—is a binary device according to the definition to be used in the following discussion.

The only information a latching relay may convey is whether it is open or it is closed. However, other meanings may be ascribed to these two states. It may be agreed that a closed relay signifies "yes". An open relay signifies "no". The state of the relay may then be used to pass yes and no information. If the probability of being in either state is 50%, the relay is said to convey one "bit" of information. The bit might consist of the yes or no referred to above, or to any other two mutually exclusive pieces of information. A closed relay might indicate the British are going by sea. An open relay, by land. Of most general interest is the mathematical case in which a closed relay represents a "one", an open relay a "naught". These agreed upon meanings constitute a code. The two pieces of information must be mutually exclusive. That is, if one piece of represented information is true, the other must be false.

Two relays may be used to convey two bits of information. Since each of the two relays may be in either of two states, the total number of states for two relays becomes $2^2$ or 4. For three relays, $2^3$ or 8. For n relays, $2^n$. Information communicable via the relays doubles with each additional relay.

Of the several codes in use today the ASCII is representative. It is an 8 bit code, one of which bits is a parity bit. The remaining 7 information bits provide for a total of 128 characters. These characters may be the arabic digits from zero to 9, letters of the alphabet, punctuation marks, mathematical symbols, or a host of special symbols used generally in teletype operations.

It is of interest that the English language is a vocal and audible code. The words printed on this paper constitute a visible code. The church bell and the noon whistle are audible codes but not vocal codes. The bell and whistle are each single bit codes. There are two general classes of codes—the binary derived codes and the arbitrary codes. The relay systems, the noon whistle, and the church bell are representative of the binary codes. The English language and the printed words on this paper are representative of the arbitrary codes—codes in which the information cannot be simply and reliably derived from binary elements of the medium of transmission.

In modern technology it becomes desirable to convert from arbitrary codes to binary codes and vice versa. Speech recognition systems are concerned with conversion of the arbitrary English language code over to a binary code. Optical character readers are concerned with conversion of printed character codes such as appear on this page (or handwritten character codes) over to binary codes. Complex and extremely costly are terms which befit both systems—even though the systems have been under development for a decade.

Conversion from binary codes to printed matter is not as difficult. Printers of many varieties having binary coded inputs and whose outputs are arbitrary characters such as here used are available.

The introduction of binary compatible characters for printed matter solves the problem of communication between binary data systems and printed matter. Since only change in configuration of characters is involved, reading the new characters by humans is no problem.

THE DRAWINGS

FIG. 6 also indicates the preferred position for Leds to be used in a display character of the configuration of FIG. 1.

DETAILED DESCRIPTION OF PREFERRED EMBODIMENT

Figure 1:
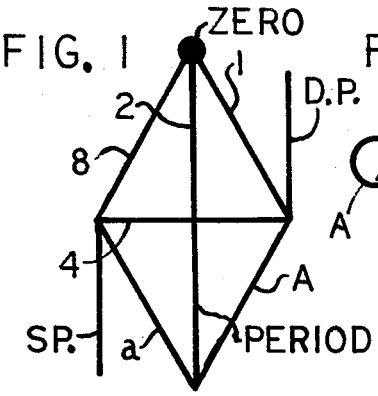
FIG. 1 is a diagram of a ten element preferred configuration of the "binary compatible character".

Germane to the present invention is the ten bit "binary compatible character" (BCC) shown in FIG. 1. The following are significant:

1. The ten elements are nine lines and the "Zero" dot.

2. Designations of the several elements could indicate the corresponding Arabic-Phoenician character when that element appears by itself.

3. The digitally designated elements (1, 2, 4, and 8) are primes of the binary numbering system. All four elements are mutually contiguous. This greatly facilitates writing characters formed of subsets of these elements, since the pencil need be raised from the paper for only two of the sixteen combinations. It also facilitates reading of a series of such handwritten characters.

Figure 2:
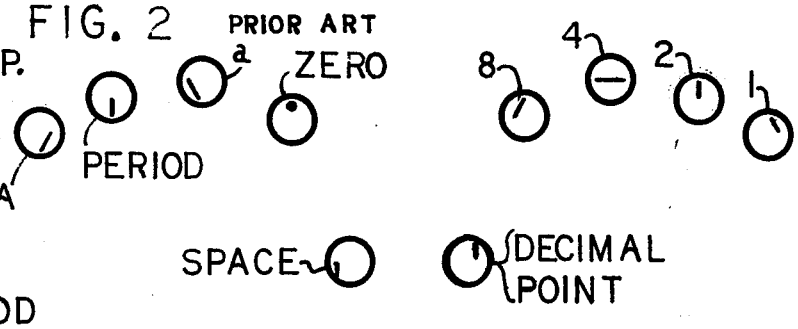
FIG. 2 PRIOR ART
FIG. 2 is a diagram showing key positions and designations for a ten-key combinational keyboard for use with the present invention.

Key positions and designations of a combinational keyboard appropriate for use in a typewriter printing BCCs appears in FIG. 2. The following are significant:

1. Designations of keys correspond to designations of elements in the BCC of FIG. 1.

2. Keys are positioned to fall naturally under the fingertips when the hands are held in their natural positions.

3. For one-handed operation, the thumb of the right hand may be shifted over to operate the SP or Space key. Either the thumb or forefinger of the right hand may be shifted over to operate the Zero key. Since all digits are handled by the right hand only, this permits all mathematical work to be performed with the one hand only.

Figure 3:
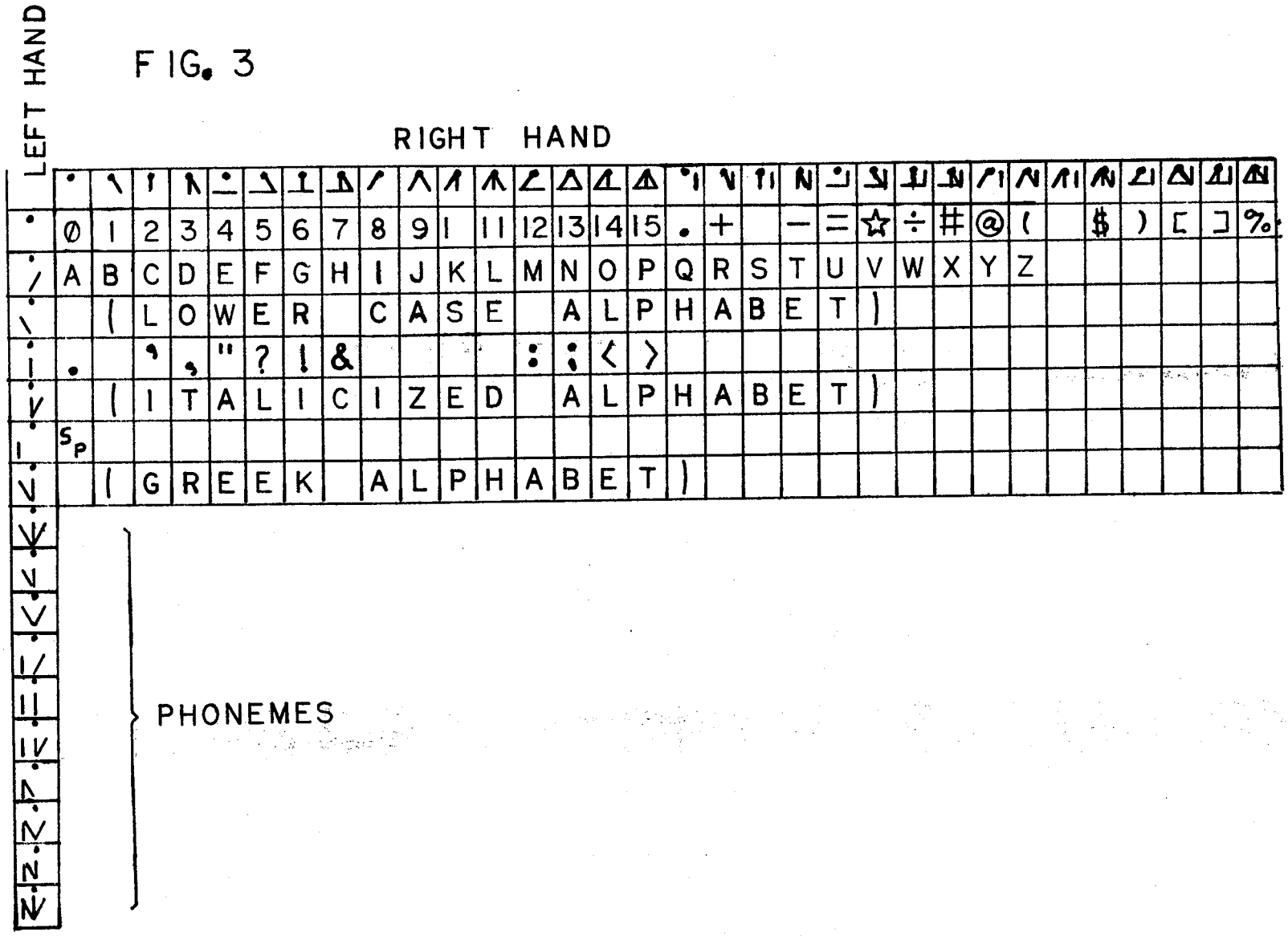
FIG. 3 is a table giving a presently used code for use with digits of the base-16 numbering system, the letters of four alphabets, a set of punctuation marks, and affording space for addition of phonemes and other elements of communication.

A binary compatible code to be referred to as Rowcode and for use with the BCC appears in FIG. 3. The upper row of BCC's may be generated by the fingers of the right hand using the keyboard of FIG. 2. Fingers of the left hand are not used. The second line gives the conventional characters represented by the BCC's directly above. The left column of BCC's may be generated by the left hand only. The second column indicates the conventional characters represented by the corresponding BCC's. Next, consider conventional letter P shown in the chart. Its corresponding BCC combines the A character shown in the left column with the 15 shown in the top row. The BCC's for all other conventional characters are formed in similar manner.

The following are significant:

1. All numerical digits and numerical operators may be generated by the fingers of the right hand. This frees the left hand for shuffling papers when numerical information is being handled.

2. The Zero key is not used in combination. This permits this key to be used as a parity generator for detecting operator errors. It also permits the Zero dot to be inserted automatically into every character without changing the meaning of the character. The Zero dot being present in all characters facilitates both visual reading and machine reading of the several characters.

3. Rowcode provides a base-16 numbering system. Binary data systems have caused the decimal numbering system to become obsolete. Just as commerce caused the Roman numeral system to become obsolete. Since efficient use of binary circuits demands the use of a binary derived numbering system (such as the base-16 system), this auxiliary feature of the present invention maximizes the utility of the binary data system. Further, it removes the necessity for converting to and from the decimal system when communicating with binary data systems.

4. The expanded capacity of Rowcode permits incorporation of both upper and lower case alphabets, an italicized alphabet, the Greek alphabet, and even a host of phonemes. The phonemes may be recorded into ROMs. They may then be formed into words of the English language or any other language.

5. Letters of the alphabet become an extension of the numbering system. The complete character of FIG. 1 becomes a binary compatible digit for a base 1024 numbering system.

Figure 4:
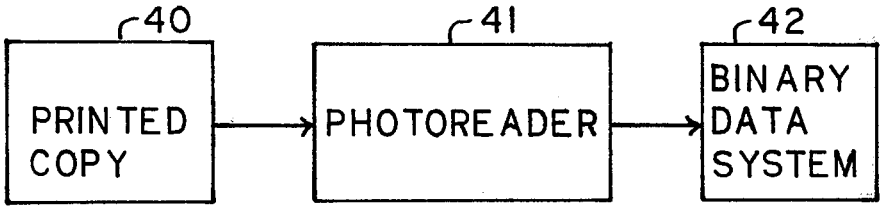
FIG. 4 is a block diagram of the simplest embodiment of the present invention.

The simplest configuration of the preferred embodiment is shown in FIG. 4. Printed copy 40 of BCCs is fed to photoreader 41. Photoreader 41 senses the elements present in each successive BCC and forms a corresponding ten bit "word" which is fed to a register in binary data system 42.

Figure 5:
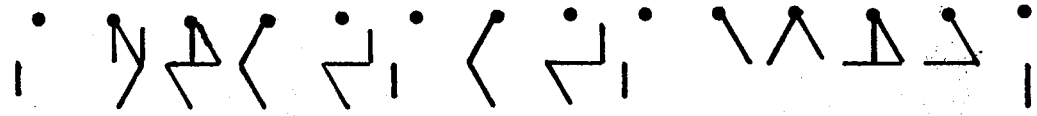
FIG. 5 is a line of binary compatible characters suitable for use with the present invention.

A sample of suitable copy for use in the above configuration appears in FIG. 5. The sentence reads "This is 1975." A person unfamiliar with Binary Compatible Characters may find the code of FIG. 3 of utility in reading the sentence. The following are significant:

1. A zero dot indicates a character position.

2. The sentence opens with a Space character. Where rows of such characters are read by a line reader, this character upon coming into registry enables all other detectors.

3. The second character is a capital "T". That it is a capital letter is indicated by the lower right line segment. The upper three line segments as indicated from the code sheet represent in letters either a "t" or a "T".

4. The third character is a lower case letter as indicated by the line segment at lower left. The upper three segments from the code sheet are recognized as indicating an "h".

5. The fourth character is another lower case letter. From the code sheet it is an "i".

6. The fifth character is a lower case letter. From the code sheet it is found to be an "s".

7. The sixth character is another Space symbol. In the prototype system electronic circuitry was incorporated to inhibit printing of the space symbol. This provided a completely blank space in conformance with traditional practice.

8. The next two characters are recognized as the word "is".

9. A third "Space" character follows.

10. The next four characters are digits as recognized from the lack of lower line segments and the lack of a vertical segment from the right vertex. From the code sheet or from FIG. 1, the digits may be recognized as being 1975.

11. The last character is from the code sheet identified as a period.

Figure 6:
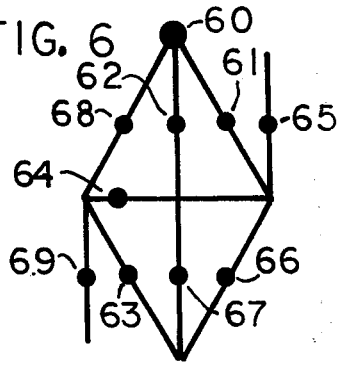
FIG. 6 is a diagram indicating positions of sensing elements suitable for sensing binary compatible characters of the configuration of FIG. 1.

In the preferred embodiment characters are read by sensing whether the copy is light or dark opposite sensing elements indicated by dots 60 to 69 of FIG. 6. In the prototype, optical fibers picked up the light reflected from the copy and fed it to remotely located sensors.

Figure 7:
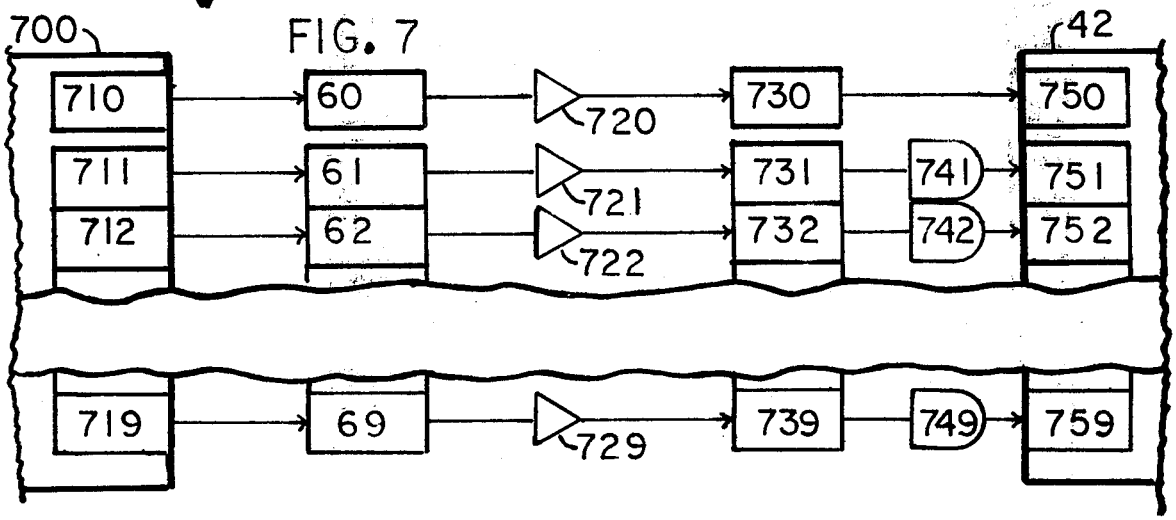
FIG. 7 is a block diagram of a prototype reader for reading binary compatible characters and delivering the results to a binary data system.

A block diagram of the prototype read system appears in FIG. 7. Read head 700 holds optical fibers 710 to 719, the tips of which are positioned to look at the elements of the character—as indicated by numerals 60 to 69 of FIG. 6. Ends should be polished using successively finer grit sandpaper and finally jeweler's rouge. The other ends of the fibers are affixed to the sensor ends of phototransistors 60 to 69—which may be type 2N5780. Phototransitors 60 to 69 in turn feed to amplifiers 720 to 729, which in the prototype were popular type 741 operational amplifiers. Amplifiers 720 to 729 feed to Schmitt triggers 730 to 739—which may be popular type 7413. Gains of amplifiers 720 to 729 are adjusted high enough to insure reliable triggering of the Schmitts from the elements being scanned, but below the level at which false triggering from noise results. In the prototype system, front lighting of the copy was used. In a preferred system the medium would be highly translucent paper and the platten would be clear plastic lighted from the rear. This would provide a much stronger signal to the sensor, permitting the bank of amplifiers to be eliminated. Schmitt trigger 730 feeds to binary device 750 in the input register of binary system 42. The chain is such that when a dot appears opposite the input tip of optical fiber 710, binary device 750 is moved from the reset to the set condition. It then remains in the set condition until a reset signal is delivered to it by the binary data system. Speed of operation of the binary datasystem must be such that the reset signal is returned before the next character reaches registry position. The output signal of the Schmitt trigger 730 is also fed to one input of each of AND gates 741 to 749—normally type TTL7400. Schmitt triggers 731 to 739 provide the other inputs to the AND gates. The arrangement is such that a gate will generate an output only during the period that a line appears opposite the corresponding optical fiber and a dot appears opposite optical fiber 710. This assures that each character is in proper registry before reading takes place. AND gates 741 to 749 feed to respective binary devices 751 to 759 in the input register of binary system 42. The result is that at completion of scanning of each character, each element appearing in the character will have caused its respective binary device in the input register to assume a set condition.

Binary data system 42 of FIG. 4 and FIG. 7 may be as simple as a single register which receives information from photoreader 41 and delivers that information to a display. Or it may be the most complex computer ever built. The only requirement on the binary data system 42 is that it contain a register for receiving input information.

Numerical information reads directly in. From FIG. 3 it is noted that numerical information is handled by bits Zero, 1, 2, 4, and 8. If the bits bearing these designations are permitted to represent respectively the digits zero, 1, 2, 4, and 8, a significant result obtains. All digits of the Base-16 numbering system may be represented by subsets of these bits by letting the number represented be equal to the sum of the designations for the elements present in any character. If the bits set respective successive binary devices in the input register, a second significant result obtains. A BCC when read by the photoreader delivers a four-bit binary numbering system representation to binary elements 751 to 759 of the input register of binary system 42. No algorithm such as that of Benson and Tabbott or conversion hardware is required to change the input information to the binary numbering system used by the binary data system. This ultimate in convenience of reading input information constitutes a most significant advantage over conventional systems using the decimal numbering system, such as that of Barnes, U.S. Pat. No. 3,559,170. The decimal numbering system is incompatible with modern binary data systems. The Base-16 numbering system using BCCs is fully compatible with modern binary data systems.

In the preferred system the printed copy is on paper forms having perforations along the edges which fit onto sprocket wheels affixed to the ends of the roller of a typewriter. The "typewriter" is modified to provide a read head in place of a typing head. Operation of the spacing mechanism causes a line of characters to be scanned. Operation of the carriage return lever causes the copy to move up one line relative to the read head and causes the read head to move to the left margin of the copy. Use of the perforated paper and sprockets insures that the Zero dot detector is in line with the Zero dots of the scanned line of characters. Stepping and carriage return may be effected manually or automatically. Characters may be scanned rapidly by releasing the carriage and allowing it to fly to the left until the right margin limit is struck.

By expanding photoreader 41 to provide a matrix for each character position and expanding the input register of data system 42 to provide a binary device for each detector, a line reader results. Reading may be coordinated with sprocket wheel position. In a preferred system, a Space character appears at the left of each line of characters. A zero dot sensor for this character feeds to control AND gates which in turn cause the characters of the line to be read into the input register. This permits a blank line to indicate end of copy.

The system distinguishes between Zero and Space. Nought is represented by the Zero dot by itself. A Space command is represented by a Zero dot plus a Space bar. In other systems noted to date (particularly that of Barnes cited above) no distinction is made between the Space and Zero.

Digits are composed of mutually contiguous elements. Where digits consist of non-contiguous elements, question can often arise as to whether a single digit is represented or two digits are represented. Question can also arise as to whether a lone element should be joined with the digit on its right or joined with the digit on its left or read by itself. These systems generally require a preprinted form with positions for the various digital elements clearly delineated. The system of dots provided by Barnes is typical. The present invention provides a set of digits each digit of which is composed of mutually contiguous elements. This avoids the shortcomings of the other systems indicated above.

Figure 8:
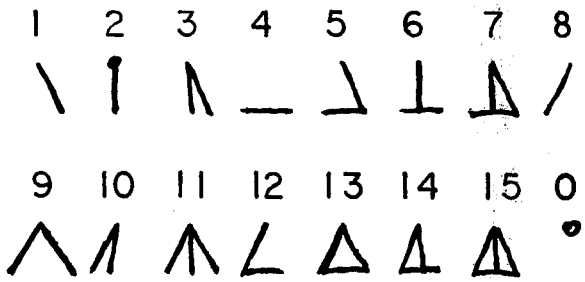
FIG. 8 is a group of handwritten digits showing modifications to insure against errors in reading the digits.

Digits are easily written by hand. FIG. 8 indicates modification of the digits appropriate for use when the digits are handwritten, which modifications insure against possible error in reading the digits. These modifications are:

1. A dot is placed at the apex of the 2. This prevents possible confusion with a 1 or an 8—which confusion might otherwise well arise, since it is impossible to write a perfectly vertical 2.

2. The 2 line of the 3 is sloped to the right. This avoids possible confusion with the 9.

3. The 2 line of the 10 is sloped to the left—to avoid possible confusion with the 9. Only the 6 and 11 require that the pencil be raised from the paper.

If handwritten characters are to be read by a photoreader, considerably more care must be exercised. In general it is better to use a matrix background. Graph paper K&E Number 46 0943 having a grid of 12×12 to the inch has been used with good results. However, the time required to write in the characters is considerably greater than the time required to key the information in on a combination keyboard.

Figure 9:
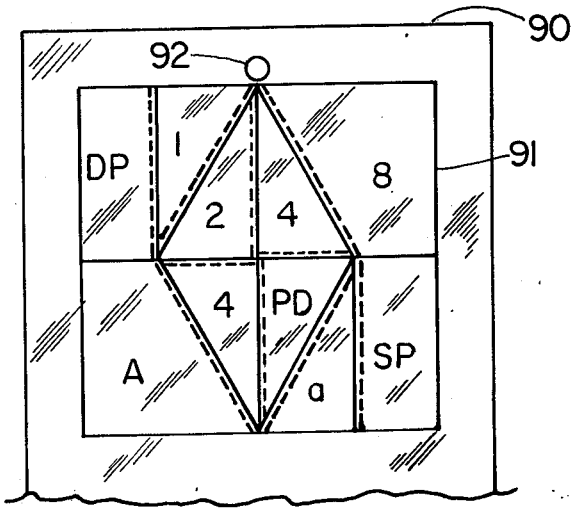
FIG. 9 is a frontal view of a printhead used in the preferred embodiment to print binary compatible characters.

A frontal view of a suitable printing head is shown in FIG. 9. Head 90 contains a rectangular space 91 into which nine hammers fit as indicated. The tenth hammer, the Zero, is a rod passing through hole 92. Element 1 is representative. It is triangular in crossection. It slides freely in a direction perpendicular to the paper. The upper surface slides on head 90. The left surface slides on element DP. The right surface slides on element 2. Element 1 has a printing surface indicated by the dotted line along the right edge. Other elements are free to slide in similar manner in a direction perpendicular to the paper. It follows that any particular BCC may be printed by bringing the head close to the typewriter ribbon and moving the desired set of hammers sharply forward against the ribbon and paper. To print the 4 line, two hammers are used.

Figure 10:
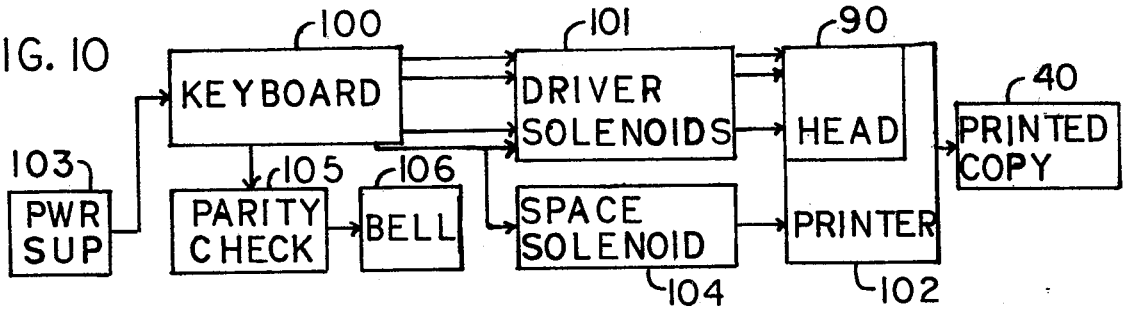
FIG. 10 is a block diagram of a key data system having as input device a combinational keyboard and having as output printed copy on which binary compatible characters appear.

A block diagram of a printing system for printing BCCs is shown in FIG. 10. The keys and printing mechanism are removed from a conventional typewriter. Print head 90 for printing BCCs is mounted in printing position. This modified typewriter becomes printer 102. A combination keyboard 100 of the type previously discussed drives solenoid bank 101. Power supply 103 supplies power for this operation. Solenoid bank 101 consists of ten solenoids which drive respective hammers in print head 90. Means associated with keyboard 100 provide a signal to space solenoid 104 whenever any key of keyboard 100 is depressed. In the prototype this means took the form of a second contact on each switch. The second contacts were wired in parallel and fed to space solenoid 104. An equally suitable system would incorporate a ten input OR gate fed by the outputs of all switches. In the preferred embodiment, the input to space solenoid 104 is also fed to the Zero solenoid of solenoid bank 101. This causes a Zero dot to be inserted into every character. It follows that the spacing mechanism operates once for each combination of keys which is depressed between two periods when no keys are depressed.

Such a system is suitable for preparing BCC information for input to the photoreader discussed previously. It may also be used to replace the conventional typewriter in the production of printed communications to be read by humans.

Experience indicates that operator errors on the combinational keyboard are recognized by the operator as quickly and surely as errors on a conventional keyboard. However, the occurrence of unrecognized errors may be insured against by incorporating a parity check into the keyboard. The operator generates odd parity by depressing the Zero key in all combinations which would otherwise generate even parity. All outputs of the keyboard then feed to parity checker 105 of FIG. 10, which checks for odd parity. Upon detection of a violation a bell 106 or other signalling device is activated. In the preferred system means are incorporated to prevent the output of a character which does not pass the parity check. This is most conveniently accomplished by feeding the parity check output to third inputs of AND gates 741 to 749 of FIG. 7.

Figure 11:
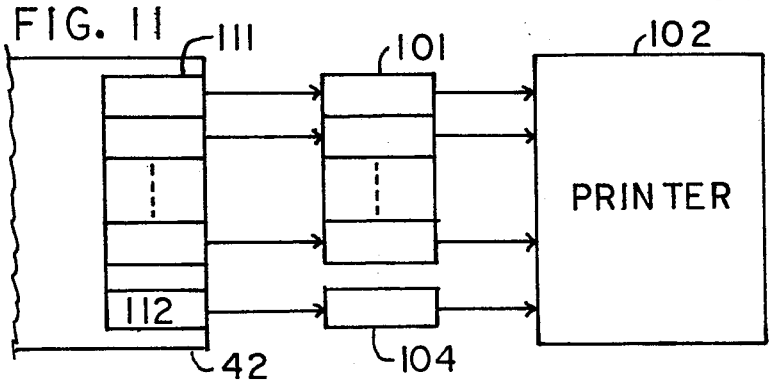
FIG. 11 is a block diagram of a printer operated from the output of a binary data system and printing binary compatible characters.
Figure 12:
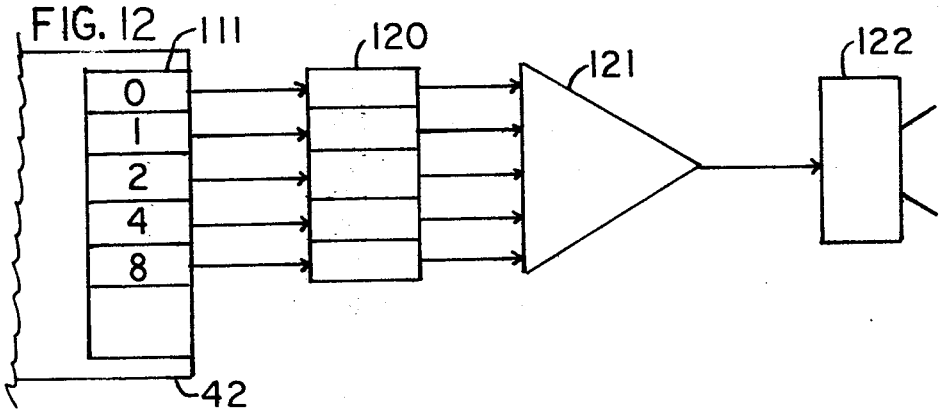

The printing system above discussed may be modified to serve as an output system for a binary data system. As indicated in FIG. 11, output register 111 of binary data system 42 serves as a source of binary data. Register 111 may consist of latching relays as previously discussed. Relay 112 feeds an appropriately timed spacing signal to space solenoid 104. Drivers 101 and printer 102 remain as previously discussed.

The output printer above discussed is slow. For speed, a line printer becomes appropriate. For a line printer the printing mechanism includes a printhead for each print position in a line of print. Output register 111 of FIG. 11 is expanded to provide one binary element for each solenoid and hammer of each printhead.

A data storage system results when copy produced by such a printer is stored and then at a later date fed back to the reader and thence to the binary data system. This system has the advantage that the copy can be edited by a human and corrections made directly on the copy. An eraser and pencil serve to make the corrections. Proper editing symbols may be inserted to delete material. Material may be added by cutting sheets, inserting the new material, and fixing it in place with Scotch tape. This provision for editing material is the prime advantage offered by this type data storage over magnetic tape, paper tape, and punched cards.

A visual display may be used to replace the printer when hard copy is not required. A preferred display for a single BCC is indicated by the structure of FIG. 6—previously discussed as a configuration for a photoreader matrix. For the display, the lines of FIG. 6 may be either dark lines on a light background or light lines on a dark background. The latter have been used in displays built thus far. Dots of FIG. 6 have thus far been Leds, although any other type visual indicator will serve as well. Lit Leds indicate the corresponding line is to be considered activated in the character being read. However, in several displays thus far built, the unlit Leds have indicated the lines to be considered activated. It is found that the human mind can learn to read the unlit Leds as easily as the lit Leds. One display built for a digital voltmeter was unique in that unlit Leds were read for positive voltages and lit Leds were read for negative voltages. It is found that the human mind can switch from one assignment to the other without difficulty.

It is apparent that many alternate configurations of the BCC are possible. The present invention is not limited to the configuration of FIG. 1.

It is also apparent that the combinational keyboard may feed directly to a binary data system without producing the printed copy.

It is also apparent that the printed copy may be prepared by a human using a pencil and a suitable coding form.

I claim:

1. In a data communication system, the combination comprising:

a. a binary data system having an input register comprising a plurality of binary devices each of said binary devices being normally in a "reset" state;

b. a medium adapted for bearing legible characters:

c. character generation means adapted for imprinting legible characters on said medium, said character generation means being adapted for forming a character comprising a subset of elements of a master character comprising a plurality of elements, said master character being of fixed configuration, one element of said master character being a dot designated zero, said zero dot representing the number nought when constituting the only element in one of said characters, and said character generation means being adapted for entering said zero dot into every character;

d. a detector matrix comprising a plurality of detectors including a zero dot detector, each of said detectors being adapted for detecting a respective element of said master character; and e. means operatively associated with said zero dot detector and adapted for enabling the remainder of said plurality of detectors during that period that said zero dot detector detects said zero dot;

each of said plurality of detectors when enabled being adapted, in response to detection of said respective element, for setting a respective binary device of said binary devices.

2. The combination of claim 1 wherein said master character comprises ten elements, nine of said elements being line segments, four of said line segments being designated 1, 2, 4, and 8, and a tenth element being a dot designated zero:

said line segments designated 1, 2, 4, and 8 forming the sides and altitude dropped to the base of a first essentially equilateral triangle having a horizontal base;

said dot designated zero being positioned at the apex of said triangle;

a fifth and sixth of said line segments forming in conjunction with said base of said first equilateral triangle a second essentially equilateral triangle having a lone vertex below said base;

a seventh line segment which is the altitude of said second equilateral triangle, said altitude extending vertically from said lone vertex;

an eighth line segment extending from the right vertex of said triangles upward a distance approximating the height of the altitude of said first triangle; and a ninth line segment extending from the left vertex of said triangles downward a distance approximating the length of the altitude of said second triangle.

3. The combination of claim 1 wherein four of said elements are designated respectively 1, 2, 4, and 8, and said four elements are mutually contiguous.

4. The combination of claim 3;

said four elements comprising the sides and altitude dropped to the base of a triangle;

said triangle being positioned relative to said dot so that said dot appears at the apex of said triangle.

5. The combination of claim 3;

said detectors for said four elements designated 1, 2, 4, and 8 being adapted for setting four respectively consecutive binary devices in said input register.

6. The combination of claim 1, said character generation means comprising;

a. an output register comprising a plurality of output binary devices, a subset of said output binary devices at any one time being in an "on" condition and the remainder of said output binary devices at said time being in an "off" condition; and b. a printer having a printing head, a plurality of drivers, a medium adapted for receiving printed characters, and a zero element insertion means, said printing head comprising a plurality of printing devices, each of said printing devices when driven being adapted for printing a respective element of said master character on said medium, said zero element insertion means being adapted for inserting said zero element into each printed character, each of said drivers being operatively associated with a respective printing device of said plurality of printing devices and each of said drivers being operatively associated with a respective output binary device of said set of output binary devices, and each of said drivers being adapted when said respective output binary device is in said "on" state for driving said respective printing device.

7. The combination of claim 1, said character generation means comprising:

a. a keyboard having a plurality of keys;

b. a printer adapted for printing said characters on said medium and having a printing head containing a plurality of printing devices, each of said printing devices being operatively associated with a respective key of said keyboard and adapted for being actuated in response to depression of said respective key, each of said printing devices when actuated being adapted for printing a respective element of said master character;

c. means adapted for causing said zero dot to be printed into every character; and d. means adapted for causing said printing head to move forward one character space in response to the depression and release of a combination of said keys.

8. A combination as in claim 7;

four of said keys being designated 1, 2, 4, and 8;

said elements printed in response to depression of keys designated 1, 2, 4, and 8 being in turn designated 1, 2, 4, and 8 respectively and forming the sides and altitude of a triangle; and each of said detectors for said elements designated 1, 2, 4, and 8 being adapted for setting a respective one of four successive binary devices in said input register when said respective element is detected.

9. The combination of claim 7 and further comprising;

e. keying error check means operatively associated with said keyboard and adapted for providing a signal perceivable by the operator of said keyboard whenever the number of keys in said combination is even.

* * * * *